United States Patent [19]

Laumbach et al.

[11] 4,148,359

[45] Apr. 10, 1979

[54] PRESSURE-BALANCED OIL RECOVERY PROCESS FOR WATER PRODUCTIVE OIL SHALE

[75] Inventors: Dallas D. Laumbach; Paul F. Koci, both of Houston, Tex.

[73] Assignee: Shell Oil Company, Houston, Tex.

[21] Appl. No.: 873,338

[22] Filed: Jan. 30, 1978

[51] Int. Cl.[2] ..... E21B 43/24

[52] U.S. Cl. ..... 166/261; 166/272; 166/306

[58] Field of Search ..... 166/261, 260, 272, 256, 166/257, 303, 250, 252, 251, 306

[56] References Cited

U.S. PATENT DOCUMENTS

| | | | |
|---|---|---|---|
| 2,874,777 | 2/1959 | Tadema | 166/261 X |
| 2,969,226 | 1/1961 | Huntington | 166/261 X |
| 3,400,762 | 9/1968 | Peacock et al. | 166/272 X |
| 3,460,620 | 8/1969 | Parker | 166/272 X |
| 3,501,201 | 3/1970 | Closmann et al. | 166/272 X |
| 3,516,495 | 6/1970 | Patton | 166/272 |
| 3,550,685 | 12/1970 | Parker | 166/272 X |
| 3,593,789 | 7/1971 | Prats | 166/261 X |
| 3,967,853 | 7/1976 | Closmann et al. | 166/272 X |

*Primary Examiner*—Stephen J. Novosad

[57] ABSTRACT

In producing shale oil from a water-productive leached zone of a subterranean oil shale the reservoir pressure is counterbalanced to restrict water production. A generally vertical heated channel is formed by injecting steam into a lower location while producing fluid from an upper location until a steam zone extends substantially between the locations. Oil shale is pyrolyzed within the heated channel by flowing gaseous fluid, which contains noncondensable components and is heated to an oil shale pyrolyzing temperature, upward through the channel. Shale oil is recovered from the fluid flowing upward through the channel while the composition, pressure and rate of flow of that fluid are adjusted to maintain a selected ratio between its oil phase and aqueous phase components.

8 Claims, 1 Drawing Figure

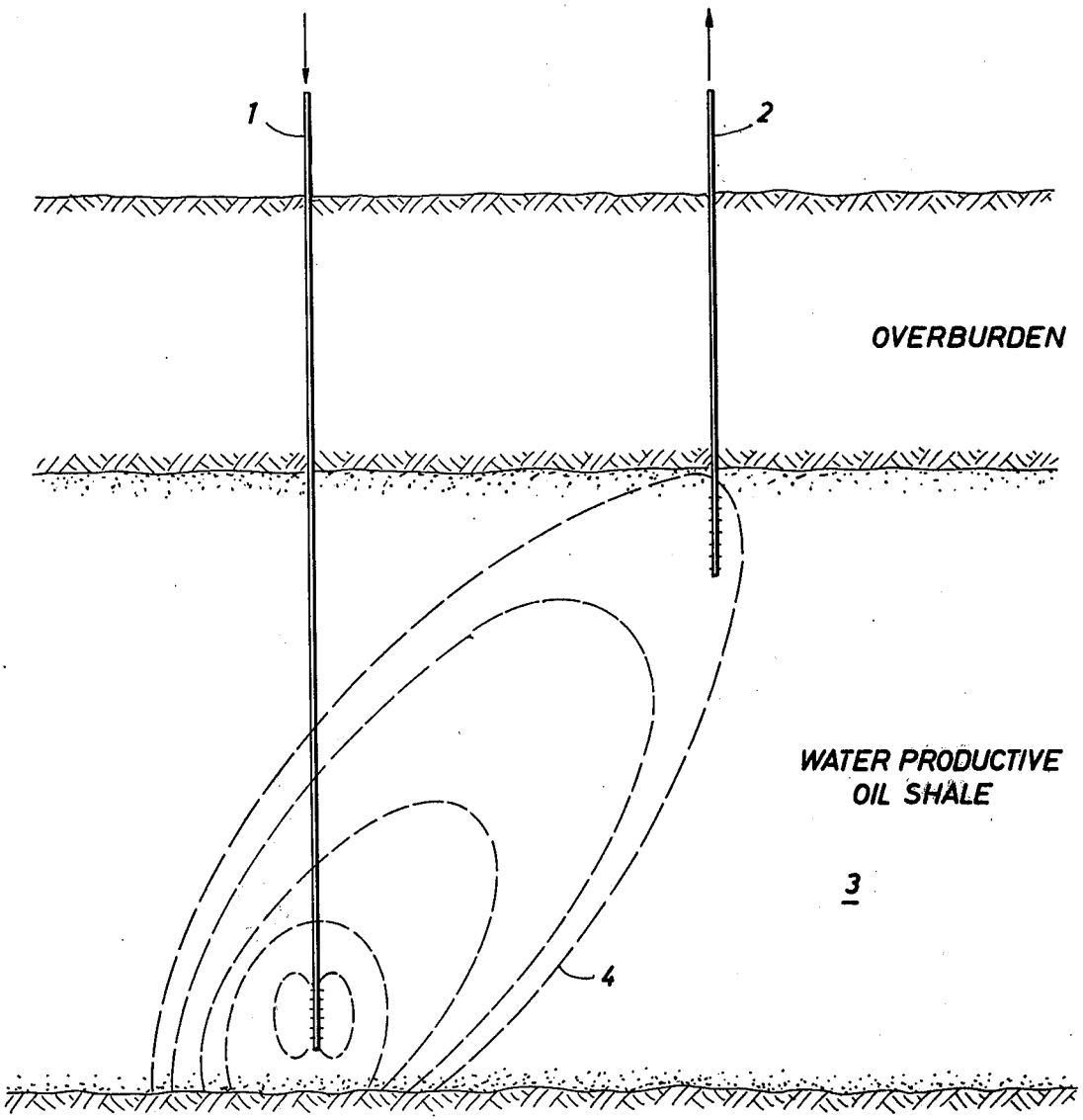
1
2
OVERBURDEN
WATER PRODUCTIVE
OIL SHALE
3
4

PRESSURE-BALANCED OIL RECOVERY PROCESS FOR WATER PRODUCTIVE OIL SHALE

BACKGROUND OF THE INVENTION

This invention relates to producing shale oil and related materials from a naturally fractured and leached portion of a subterranean oil shale formation of the type encountered in the Piceance Creek Basin in Colorado.

Numerous portions of subterranean oil shale formations of the above type contain substantially impermeable kerogen-containing minerals mixed with water-soluble minerals or heat-sensitive minerals which can be thermally converted to water-soluble materials. A series of patents typified by the T. N. Beard, M. N. Papadopoulos and R. C. Ueber Pats. 3,739,851; 3,741,306; 3,753,594; 3,759,328 and 3,759,574 describe processes for recovering shale oil from portions of subterranean oil shale formations which are substantially free of interconnected flow paths. However, where an oil shale formation containing such mixtures of components has been naturally fractured and/or leached, the impermeable kerogen-containing components tend to be surrounded by a network of interconnected flow paths. In such a flow path-permeated formation the capture of the shale oil which is generated is difficult unless the path to a nearby production well is the path of least resistance.

The M. J. Tham and P. J. Closmann U.S. Pat. No. 3,880,238 relates to downflowing an oil shale pyrolyzing fluid through a rubble-containing cavern and discloses that plugging can be avoided by keeping the cavern substantially liquid free by using (as a pyrolyzing fluid) a mixture of (a) fluid which is significantly miscible with at least one organic or inorganic solid component of the oil shale or its pyrolysis products, and (b) fluid which is substantially immiscible with such materials. The P. J. Closmann U.S. Pat. No. 4,026,359 relates to producing shale oil from a "leached-zone" subterranean oil shale by conducting a generally horizontal steam drive between injection and production locations in the lower portion of the leached-zone until the production becomes impaired by plugging near the producing location, then injecting steam through that location while producing from a location substantially directly above it. The G. Drinkard U.S. Pat. No. 4,026,360 relates to producing shale oil from a leached-zone subterranean oil shale formation from within a fluid-confining barrier, by (a) reacting the formation components with hot alkaline fluid to form a barrier and (b) conducting an in situ pyrolysis of the oil shale within the confines of the barrier.

SUMMARY OF THE INVENTION

The present invention relates to producing shale oil from a water-productive leached-zone subterranean oil shale formation which has a composition at least similar to those encountered in the Piceance Creek Basin in Colorado and contains an interconnected network of water-productive relatively permeable channels formed by the natural fracturing or leaching of the formation. At least one well is completed within the formation to provide a means for injecting fluid into and producing fluid from the oil shale. A generally vertical heated channel is formed by injecting steam into at least one lower location within the leached-zone while fluid is produced from at least one higher location within that zone. The pressures, flow rates and volumes of the injected steam and produced fluid are adjusted to extend a substantially steam-filled zone from each injection location to at least near each production location. Oil shale is pyrolyzed by flowing a gaseous fluid which contains effectively noncondensable components and is heated to an oil shale pyrolyzing temperature upward within said channel. As used herein the term "effectively noncondensible" component or gas refers to a gaseous material which remains gaseous at the pressure and temperature it encounters within the leached zone subterranean oil shale formation being treated. Shale oil is recovered by producing fluid from the upper portion of the channel while adjusting the composition, temperature, pressure and rate of flow of the fluid in the channel to maintain a selected ratio of oil phase and water phase components within the produced fluid.

DESCRIPTION OF THE DRAWING

The drawing is a schematic illustration of a subterranean leached-zone oil shale formation in which the process of the present invention is being employed.

DESCRIPTION OF THE INVENTION

The present invention is, at least in part, premised on the discovery of the existence of a fortuitous combination of properties with respect to a leached-zone subterranean oil shale. The properties of (a) the pressure of the water in such a formation, (b) the pressure at which a substantially dry steam has a temperature of from about 400°-500° F., (c) the rates and pressures at which hot aqueous or nonaqueous fluids or combustion-supporting or combustion-produced fluids which contain at least some effectively noncondensable gaseous components can be injected into and produced from a heated channel within such an oil shale formation, (d) the rates at which the solid components of an oil shale or oil shale pyrolysis products can be dissolved or pyrolyzed by hot aqueous or nonaqueous fluids, and (e) the pressures and flow rates at which a hot fluid-effected pyrolysis of oil shale kerogen can be initiated and maintained within such an oil shale have a combination of relative magnitudes such that a generally vertical heated channel can be formed and used for circulating a gaseous oil shale pyrolyzing fluid while providing an economically attractive rate and efficiency of shale oil production.

As used herein "oil shale" refers to an aggregation of inorganic solids and a predominately hydrocarbon-solvent-insoluble organic-solid material known as "kerogen". "Bitumen" refers to hydrocarbon-solvent-soluble organic material that may be initially present in an oil shale or may be formed by a thermal conversion or pyrolysis of kerogen. "Shale oil" refers to gaseous and/or liquid hydrocarbon materials (which may contain trace amounts of nitrogen, sulfur, oxygen, or the like) that can be obtained by distilling or pyrolyzing or extracting organic materials from an oil shale. "Water-soluble inorganic mineral" refers to halites or carbonates, such as the alkali metal chlorides, bicarbonates or carbonates, which compounds or minerals exhibit a significant solubility (e.g., at least about 10 grams per 100 grams of solvent) in generally neutral aqueous liquids (e.g., those having a pH of from about 5 to 8) and/or heat-sensitive compounds or minerals, such as nahcolite, dawsonite, trona, or the like, which are naturally water-soluble or are thermally converted at relatively mild temperatures (e.g., 500°-700° F.) to materials which are water soluble. The term "water-soluble-mineral-containing subterranean oil shale" refers to an oil shale that contains or is mixed with at least one water-soluble inorganic mineral, in the form of lenses, layers, nodules, finely-divided dispersed particles, or the like.

A leached-zone or water-productive oil shale formation to which the present process is applied can be substantially any having a chemical composition at least similar to those encountered in the Piceance Creek Basin of Colorado and containing a naturally occurring network of interconnected water-productive channels. Particularly suitable leached-zone oil shale formations comprise the Parachute Creek members of the Piceance Creek Basin which are sandwiched between overlying and underlying formations that are relatively impermeable. Such formations often contain water soluble inorganic minerals in the form of halites, carbonates, nahcolites, dawsonites, or the like.

In the present process, the wells which are opened into fluid communication with the oil shale formation to be treated can be drilled, completed and equipped in numerous ways. The fluid communication can be established by substantially any of the conventional procedures for providing fluid communications between conduits within the well boreholes and the surrounding earth formation over intervals of significant vertical extent. Where desirable, a single well can be equipped to provide both the means for injecting fluids into and for producing fluid from the oil shale. However, the use of a pattern of injection and production wells is preferred, with the wells completed so that the production locations are higher than the injection location by distances such as 150–750 feet and are spaced laterally from the injection locations by distances such as 0–500 feet.

The drawing shows a pair of injection and production wells arranged for use in the present process. An injection well 1 and a production well 2 are opened into, respectively, lower and higher location within a leached zone oil shale formation 3. Such wells can be drilled and completed in numerous ways, including substantially any of the conventional procedures for providing cased and perforated or open-hole completions. The preferred lengths of completion intervals for the injection or production wells are from about 25 feet to 75 feet. The injection and production wells are equipped with means for controlling the pressures and flow rates of injected or produced fluids, such as those conventionally used in wells designed for thermal processes.

Each injection well is completed into a lower location which is preferably within the bottom 10% of the formation. Where such a water-productive oil shale overlies a substantially impermeable oil shale formation, the open interval of the injection well can be extended into the underlying oil shale. If desired, fracturing or leaching or the like techniques can be utilized to provide a permeable path from the lower portion of such a completion interval into the overlying water-productive oil shale.

The open interval of each production well is preferably located within the upper 10% of the water-productive oil shale. As known to those skilled in the art, the desirable distance between the injection and production locations will depend on the composition and permeability of the water-productive oil shale formation. And, fracturing or the like can be utilized to extend the suitable spacing where the permeability is relatively low. In general, the spacing should be such that there is a significant pressure response between the injection and production intervals. The existence of such responses can be detected by means of pressure-pulsing or similar types of tests.

The initial phase of the present process is primarily directed to extending a substantially steam-filled zone substantially all the way between the injection and production locations. Where desirable, the first injected fluid can comprise aqueous fluid at substantially ambient temperature, with the temperature of the fluid being raised continuously (or in increments) until the aqueous fluid being injected is a substantially dry or superheated steam at a temperature in the order of from about 400° to 500° F. The temperature, pressure and rate of the hot aqueous fluid injection is preferably adjusted to maximize water removal, drying and preheating of the oil shale. Such effects are increased by increasing the rate and volume of steam that flows from the injection to the production location, since an increase in flow rate tends to increase the amount of formation water that is entrained and removed. The rate of drying is also increased by increasing the temperature of the steam zone to one that tends to vaporize the water within the zone being heated. On the other hand, as the temperature approaches or exceeds about 500° F. the rate of oil shale pyrolysis is increased. Where the depth of the injection location is more than about 1400 feet, or in any situation such that the injection pressure or formation water pressure is more than about 670 psi, the injected steam can advantageously be mixed with pressurized inert gases (such as nitrogen or carbon dioxide) to increase the pressure at which the steam-containing fluid can be injected without increasing the temperature of the steam. In general, the injection pressure should exceed the local hydrostatic pressure by amounts such as from about 50 to 2500 psi to provide a relatively rapid rate of steam inflow to enhance the entraining and removing of formation water. While steam or other hot aqueous fluid is being injected to establish a steam zone between the injecting and producing locations, the rate of producing fluid is preferably kept as high as feasibly possible, in order to provide a pressure sink in and around the production location.

Steam injection is preferably continued until a steam breakthrough into the production locations is at least imminent. At about this time the fluid production rate is throttled back to the extent required to maintain the pressure of substantially dry steam at a temperature of at least about 400° F.

The injecting of steam while producing fluid tends to cause the steam zone to expand with time in the manner illustrated by the series of dashed lines 4 on the drawing. As known to those skilled in the art, the imminence of steam breakthrough is detectable by continuously or intermittently monitoring the temperature of the fluid being produced from well 2.

In one embodiment, after the steam zone has been extended substantially between the injection and production locations, such as wells 1 and 2, a gaseous fluid which contains effectively noncondensable gas components and is heated to an oil shale pyrolyzing temperature is flowed upward through the heated channel by injecting a combustion-supporting gas such as air through well 1 to initiate and maintain an underground combustion. In the initial stages, the combustion-supporting fluid can be mixed with the steam being injected and its proportion continuously or incrementally increased or, if desired, the steam injection can be terminated and replaced by an injection by the combustion-supporting fluid. Numerous procedures for initiating and maintaining underground combustion can be employed. Suitable procedures are described in the J. A. Herce, S. M. O'Brien and M. Prats U.S. Pat. No. 3,537,528. The steam preheated permeable oil shale material can be contacted with a relatively easily oxidizable material along with combustion-supporting fluid. Techniques for such an oxidizable material enhanced ignition are described in U.S. Pat. No. 2,863,510. Particularly suitable techniques for advancing an underground combustion through a permeable earth formation while recovering oil from the produced fluids are described in patents such as U.S. Pat. No. 3,196,945 and 3,208,519. Where the oil shale is relatively rich and the steam preheating has raised the temperature to about 500° F., the ignition can often be accomplished by simply adjusting the combustion-supporting gas content of the fluid being injected to one capable of supporting combustion.

Alternatively, the oil shale pyrolyzing fluid can be flowed upward through the heated channel by preheating an effectively noncondensable gas such as nitrogen or a mixture of gases containing a noncondensable gas in a surface and/or downhole location within a well bore and then injecting it through well 1 while producing fluid through well 2. Such a preheated gas can initially be mixed with the steam that was injected to form a heated channel and the proportion of the preheated gas to steam can be continuously or incrementally increased until most or all of the steam has been replaced by the preheated gas.

Particularly, where the oil shale formation contains significant proportions of water-soluble inorganic materials, the pyrolysis fluids used in the present process can comprise hot solvent fluids or hot nonsolvent gases, or mixtures of such fluids of the type described in U.S. Pat. No. 3,880,238 for use as pyrolyzing fluids to be flowed downward through a rubble-containing cavity. Such a hot solvent fluid preferably comprises fluid which is heated to a temperature of from about 500°-700° F. and, at that temperature, exhibits significant miscibility with at least one of the organic or inorganic solid components of the oil shale or its pyrolysis products. Such fluids preferably contain or consist essentially of steam employed at such a temperature under conditions causing condensation in contact with the oil shale, and may also include or comprise hydrocarbons such as benzene, toluene, shale oil hydrocarbons, oil soluble gases such as carbon dioxide, mixtures of such fluids, or the like.

A hot nonsolvent gas suitable for use as the effectively noncondensable gas containing oil shale pyrolyzing fluid in the present process can comprise substantially any gas having a temperature of from about 500°-1500° F. and at such a temperature having a relatively insignificant miscibility with any of the organic or inorganic solid components of the oil shale or pyrolysis products of it (e.g., having a solubility of less than about 1 part per thousand with such solid or liquid components of the oil shale or oil shale pyrolysis products). Examples of suitable nonsolvent gases include nitrogen, natural gas, combustion gases, methane, substantially free of higher hydrocarbon mixtures of such gases and the like.

In the present process such hot solvent and nonsolvent fluids can be injected as mixtures or as alternating slugs of fluid flowed upward through the heated channel in the oil shale. The composition, temperature, pressures and flow rates of such fluids and the fluid produced from the heated channel within the oil shale are preferably correlated to maintain a suitable rate of production of shale oil while maintaining a suitable ratio of oil phase to aqueous phase components in the produced fluid. As known to those skilled in the art, such correlation of properties and flow rates can be accomplished by adjusting the compositions and/or the injection pressures (and thus the rates) and/or the temperatures of the fluids being injected, adjusting the backflow resistance (and thus the flow rates) of the fluid being produced from the heated channel, etc. The beginning of any plugging-induced impeding of the production can be detected by an increase in the injection pressure rate required to sustain an equiv lent rate of injection and decrease the rate of inflow or outflow at a given pressure, or the like.

In general, whether the oil shale pyrolyzing fluid is preheated or heated in situ by underground combustion, the outflow of produced fluids is preferably throttled to the extent required to maintain the pyrolyzing fluid at a temperature in the range of from about 500° to 1500° F. while the rate at which the pyrolyzing and/or combustion-supporting and combustion-produced fluids are flowing through the heated channel is sufficient to maintain an oil-water ratio within the produced fluid of at least 0.10. As known to those skilled in the art, such an adjusting of the pyrolyzing fluid temperature while maintaining a substantially constant flow rate within the heated channel can be accomplished in numerous ways.

Where in situ combustion is used, effective proportions of water can be mixed with the combustion-supporting gases to provide a so-called wet combustion at a relatively reduced temperature. Alternatively, substantially inert fluids, such as nitrogen or $CO_2$, can be mixed with the injected combustion-supporting gas to lower the temperature within the combustion zone. In the present process, since water from the water-productive oil shale formation tends to be entrained within the injected combustion-supporting gases, it is generally preferable to maintain a relatively high pressure on the fluids flowing through the heated zone and to include inert gas in the injected combustion-supporting gas to the extent required to maintain the temperature of the combustion zone in the order of about 1000° F. while maintaining an average pressure within that zone in the order of about 1000psi. Where preheated gaseous fluids are used, their compositions, temperatures, pressures and flow rates are preferably adjusted by analogous procedures to provide similar pressures and temperatures within the heated channel.

The present process is preferably employed in water-productive oil shale formations of the type encountered in the Piceance Creek Basin in Colorado having depths in the order of from about 1000 to 3000 feet, and thicknesses in the order of from about 250 to 750 feet. In such operations injection well patterns such as 7-spot or 9-spot patterns in which a plurality of production wells are responsive to each injection well are preferably employed with the respective injection and completion intervals located within the lower and upper 10 percent of the water productive oil shale intervals.

What is claimed is:

1. A process for producing shale oil from a subterranean oil shale formation, which comprises:

providing means for injecting fluids into and producing fluids from an oil shale formation by opening at least one well into fluid communication with a subterranean leached-zone oil shale formation having a composition at least substantially equivalent to those portions of oil shale formations encountered in the Piceance Creek Basin of Colorado which contain networks of relatively permeable interconnected water-filled and water-productive flow channels formed by natural fracturing or leaching of the formation;

providing a generally vertical heated channel extending through said formation between an injection location underlying a production location by injecting steam into the lower location while producing fluid from the higher location and adjusting the composition, pressure, flow rate and volume of the injected and produced fluid to enhance water removal, drying and preheating of the oil shale so that a substantially steam-filled zone is extended from each injection location to at least near each production location;

injecting a gaseous fluid which contains effectively noncondensible gaseous components and is heated to an oil shale pyrolyzing temperature into the lower portion of the heated channel so that oil shale is pyrolyzed by hot fluid flowing upward through the channel; and producing shale oil from an upper portion of the heated channel while adjusting the composition, pressure and flow rate of the injected and produced fluid to restrict the production of water by counterbalancing the reservoir pressure and to maintain a ratio of oil-phase to water-phase components of at least about 0.10 within the produced field.

2. The process of claim 1 in which the production location is higher than the injection location by about 150–750 feet and is spaced laterally from the injection location by about 0–500 feet, with the respective injection and production locations being within the lower and upper 10% of the oil shale formation.

3. The process of claim 1 in which the steam injected to form the heated channel has a temperature of from about 400°–500° F. and the fluid injected to pyrolyze oil shale within the heated channel is flowed through the channel at a temperature of from about 500°–1500° F. at a pressure exceeding that of the reservoir fluid pressure by from about 50–2500 psi.

4. The process of claim 1 in which the fluid injected to pyrolyze oil shale within the heated channel is preheated at a surface location or within a well bore prior to its injection into the channel.

5. The process of claim 1 in which the fluid injected to pyrolyze the oil shale within the heated channel is heated by an underground combustion within that channel.

6. The process of claim 5 in which the gas injected to support the underground combustion is a mixture of combustion-supporting gas and inert effectively noncondensible gas.

7. The process of claim 6 in which water is contained in the gas injected to provide the underground combustion.

8. The process of claim 6 in which the underground combustion is controlled to maintain a combustion zone pressure and temperature of about 1,000 psi and 1000° F.

* * * * *